United States Patent [19]

Schimko

[11] 4,398,401

[45] Aug. 16, 1983

[54] STRAIGHT KNITTING MACHINE

[75] Inventor: Reinhold Schimko, Aalen, Fed. Rep. of Germany

[73] Assignee: Universal Maschinenfabrik Dr. Rudolf Schieber GmbH & Co. KG, Westhausen, Fed. Rep. of Germany

[21] Appl. No.: 249,570

[22] Filed: Mar. 31, 1981

[30] Foreign Application Priority Data

Apr. 3, 1980 [DE] Fed. Rep. of Germany ..... 3013145

[51] Int. Cl.[3] ..... D04B 7/04

[52] U.S. Cl. ..... 66/64; 66/115; 66/109; 66/60 R

[58] Field of Search ..... 66/60, 60 H, 60 R, 64, 66/115, 109

[56] References Cited

U.S. PATENT DOCUMENTS

| | | | |
|---|---|---|---|
| Re. 29,861 | 12/1977 | Dietschy et al. | 66/64 |
| 3,049,900 | 8/1962 | Bram | 66/60 |
| 3,153,922 | 10/1964 | Bram | 66/64 |
| 3,307,376 | 3/1967 | Seiler | 66/115 X |
| 3,509,737 | 5/1970 | Shima | 66/115 |
| 3,973,416 | 8/1976 | Kohler | 66/64 |
| 4,027,504 | 6/1977 | Dietschy et al. | 66/64 |
| 4,081,973 | 4/1978 | Theys | 66/64 |

FOREIGN PATENT DOCUMENTS

| | | | |
|---|---|---|---|
| 826394 | 1/1960 | United Kingdom | 66/60 H |

*Primary Examiner*—Ronald Feldbaum
*Attorney, Agent, or Firm*—Sughrue, Mion, Zinn, Macpeak and Seas

[57] ABSTRACT

A straight knitting machine having two needle beds with knocking-over combs disposed in an inverted V-shaped configuration and a sliding carriage located above said needle beds is further provided with horizontal stop edges on said combs beneath the crossover zone of the needles associated with said needle beds for preventing the upward movement of the knitted piece upon activation of the needles. A pair of rotatable heads are mounted on a common support movable with said carriage with each head having a layering device mounted thereon and displaced 90° from a stripping device and a hold down device which are also mounted on each rotatable head. The heads are rotatable at the end of each traversing movement of the carriage so as to locate the layering device and hold down device of one head in advance of the knitting zone and the layering device of the other head in trailing relation to the knitting zone during a subsequent pass of the carriage.

7 Claims, 3 Drawing Figures

STRAIGHT KNITTING MACHINE

BACKGROUND OF THE INVENTION

The present invention is directed to a straight knitting machine having two needle beds and knocking-over combs arranged in an inverted V-shape configuration for knitting without the application of takeoff tension on the knitted piece and devices to locate the stitches beneath the needle crossover zone with such devices being mounted on the sliding carriage for movement relative to the needle bed.

In conventional straight knitting machines having two needle beds and knocking-down combs arranged in an inverted V-shaped configuration, a tension is applied to the knitted piece during knitting so that the stitches or loops depending from the needles slide on them under pressure. As a result of such tension, the previously knitted piece will not be pushed upwardly as the needles are advanced outwardly of the slots in the needle bed so that the tongues of the needles are properly opened and closed by the stitches or loops. After the stitches or loops are knocked-down over the closed needles, the newly formed row of stitches is pulled downwardly between the two needles beds by means of the tension on the previously knitted piece. The tension on the knitted piece is provided by take up rollers operatively located beneath the needle beds.

The disadvantage of such straight knitting machines is that the tension on the center of the knitted piece is different from the tension on the edges of the knitted piece. Furthermore, it is not possible with such straight knitting machines to produce knit-goods where the knitting is not always effected over the entire width. Thus, it is not possible to save material or to knit the correct shape when simultaneously knitting individual knitted parts since, in this instance, groups of needles on the needle bed are not knitting for several rows or the stitches are popped off these needles. In order to permit this type of stitching, straight knitting machines were developed in which a wire, fastened to the sliding carriage, runs beneath the needle crossover zone to prevent the knitted piece which is not tensioned from being lifted above the knocking-over combs of the needle beds by means of the activated upwardly moving needles. Complicated devices are then required which swivel and turn and which are shifted, lifted and lowered at the end of each knitted row so that the wire will take the proper position for knitting the following row without additional lost motion of the sliding carriage. Furthermore, the hold down effect provided by such wire could only be achieved in the case of knitted pieces being produced simultaneously on both needle beds, that is, with double knitwear but not with the production of single knitwear.

A straight knitting machine of the type described above is, for example, disclosed in German publication 1956190. In this machine, the stitches can only be held beneath the needle crossover zone with the passing of the sliding carriage by means of frictional contact. A device on the sliding carriage of the straight knitting machine is disclosed in German Utility Patent 7795391 which has a wire bracket acting as a stripping, holding and layering device with the passing of the sliding carriage. Separate stripping and holding devices are disclosed in Austrian Patent 214050.

SUMMARY OF THE INVENTION

The present invention provides a new and improved straight knitting machine having two needle beds and knocking-over combs arranged in an inverted V-shaped configuration which permits knitting of properly shaped one and two bed knitwear and particularly knitting of separate knitted pieces in a simple and accurate manne without the need for a takeup device. This is accomplished by the provision of stop means attached to the knocking-over combs which are located beneath the needle crossover zone to limit the upward movement of the previously formed rows of stitches.

The sliding carriage is provided with a stripping device and a hold down device located in advance of the point of knitting, and it is further provided with a layering device which follows the point of knitting to place the newly formed stitches behind the stop means. Advantageously the stop means are formed by horizontal edges on the knocking-over combs located beneath the vertical knocking over edges of the combs.

With such a straight knitting machine, it is possible to achieve in a very simple manner and with a minimum of technical complications single bed knitwear as well as two bed knitwear without the necessity for takeup tension on the knitted piece. The layering device places the newly formed rows of stitches behind the stops so as to prevent the knitted piece from being lifted upwardly as the needles are advanced. As a result, a differential tension across the width of the knitted piece does not occur. Additionally, in the case of double bed knitwear, the hold down device prevents the previously formed rows of stitches from being pulled away from the stop means due to the tension on the knitwear.

The layering device according to the present invention is comprised of a spring bracket having an essentially horizontal part which pushes the knitwear downwardly and places the newly formed rows of stitches behind the stop means. The stripping device is comprised of a wire bracket and is arranged in such a manner that when the needles are driven out, the stripping device will slide along the lower edges of the needles. The hold down device is comprised of a spring wire arranged behind the stripping device in the direction of movement. The spring wire is provided with an essentially horizontal portion which holds the preceding rows of stitches behind the stops. The spring effect of the hold down device readily adapts the hold down device to the firmness of the knitwear. Advantageously, the layering device is disposed at a 90° angle from the stripping device and hold down device upon a common rotatable head which can be rotated 90° and locked in either position by means of a locking slide engageable in corresponding grooves of the rotatable head. The rotatable head is mounted on the supported which can be moved with the sliding carriage which moves over the needle beds. In order to permit optional knitting in both operating directions of the sliding carriage two rotatable heads are provided on the common support in association with each knitting system.

The foregoing and other objects, features and advantages of the invention will be apparent from the following more particular description of the embodiment of the invention as illustrated in the accompanying drawings.

DETAILED DESCRIPTION OF THE INVENTION

Figure 1:
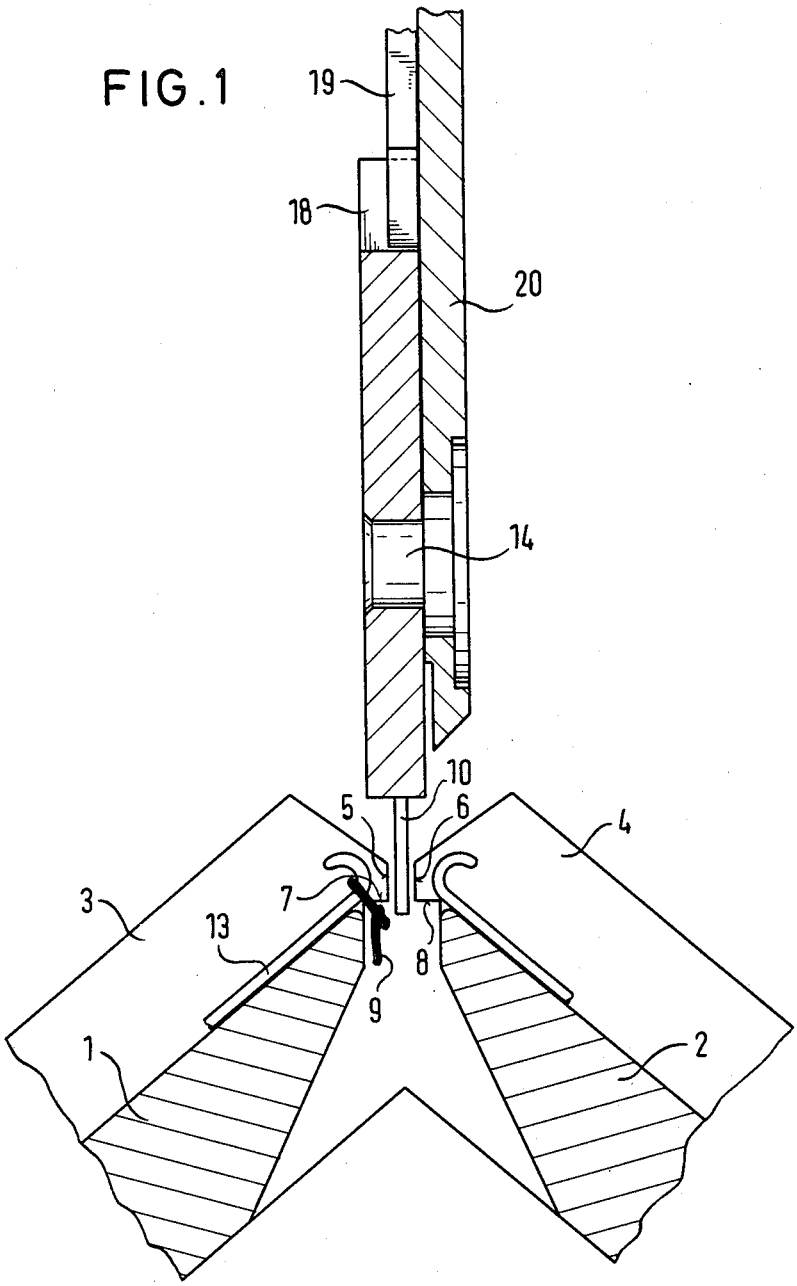
FIG. 1 is a cross-sectional view of a rotatable head disposed above the needle beds of a straight knitting machine.

The upper ends of two needle beds 1 and 2 are shown in FIG. 1 having knocking-over combs 3 and 4 associated therewith having essentially vertical knocking over edges 5 and 6. The knocking over combs 3 and 4 are further provided with stops 7 and 8 in the form of horizontal edges located beneath the vertical knocking over edges 5 and 6, respectively. Newly formed rows of stitches 9 are placed beneath the stops 7 and 8 by means of the layering device 10 which is comprised of a spring bracket or wire. The knocking over edges 5 and 6 prevent the knitwear previously produced from being lifted up when the needles are advanced.

Figure 2:
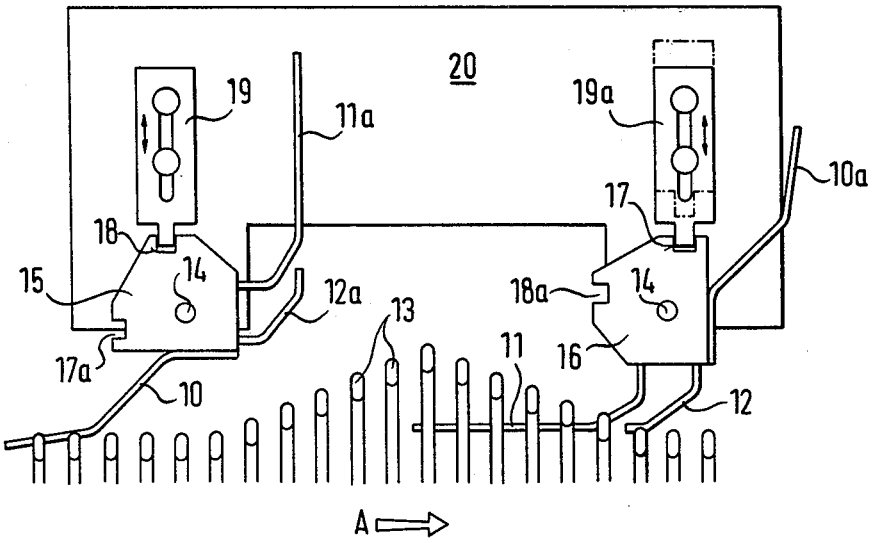
FIG. 2 is a front view of a support having two rotatable heads in position for movement above the needle beds from left to right.
Figure 3:
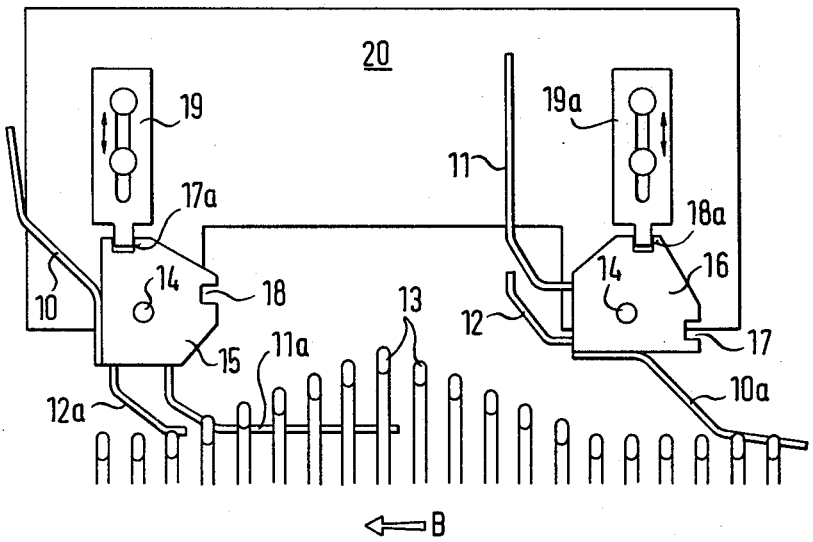
FIG. 3 is a front view similar to FIG. 2 with the two rotatable heads positioned for movement above the needle beds from right to left.

In FIG. 1, the row of stitches 9 of a single bed knit piece is shown held beneath the stops 7 by means of layering device 10 so that it cannot be lifted up. The hold down device 11, shown in FIGS. 2 and 3, is comprised of a spring wire which prevents the lifting up of the knitwear when the needles 13 are advanced. The needles 13 interact with a stripping device 12 which is also comprised of a wire bracket during the knitting of double bed knitwear.

The shapes of the layering device 10, the hold down device 11, and the stripping device 12 can be clearly seen in FIGS. 2 and 3. The layering device 10 is attached to one side of a rotatable head 15 which can be rotated 90° about axle 14. A layering device **10*a* is attached to a second rotatable head 16 which is structured as a mirror image relative to the first head 16. Stripping device 12*a* and hold down device 11*a* are connected to a second side of rotatable head 15 which is disposed at an angle of 90° relative to the first side. Likewise stripping device 12 and hold down device 11 are attached to a second side of swivel head 16 which is disposed at a 90° angle relative to the side of the head upon which the layering device 10*a*** is mounted.

The rotatable head 15 is provided with grooves **17*a* and 18 which are adapted to receive a complementary end portion of a locking slide 19 which is slidably mounted on the support 20. Likewise, the rotatable head 15 is provided with grooves 17 and 18*a* which are adapted to receive the complementary end portion of locking slide 19*a* which is also mounted on the support 20. When the locking slides 19 or 19*a* are shifted upwardly as viewed in FIG. 2, the associated rotatable head will be unlocked for rotation from the position shown in FIG. 2 to the position shown in FIG. 3**. Downward movement of the locking slide will then lock the head in its new position.

The rotatable heads 15 and 16 as shown in FIGS. 2 and 3 are rotatably mounted on axles 14 carried by a common support 20. The common support 20 is moved, when required, over the needle beds 1, 2 along with the sliding carriage externally of the needle space of the machine. At the end of each passage of the carriage, the locking slides 19 and **19*a* are moved upwardly by any suitable means (not shown) and the rotatable heads 15 and 16 are rotated 90° by switching means which are not shown. FIG. 2 shows the rotatable heads 15 and 16 in position for movement above the needle beds from left to right in the direction of the arrow A together with the sliding carriage which is not shown. In this instance, the layering device 10 is rotated into operating position on the axle 14 in follow up to the knitting zone while the stripping device 12*a* and the hold down device 11*a* attached to the same rotatable head are out of operation. The stripping device 12 and the hold down device 11 which are attached to rotatable head 16 are rotated into their operating position in advance of the knitting zone, while the layering device 10*a* on the rotatable head 16** is out of operation.

FIG. 3 shows the positions of the rotatable heads 15 and 16 for sliding carriage movement from right to left, whereby the rotatable heads 15 and 16 will move above the needle beds 1 and 2 in the direction of the arrow B. In this mode of operation, the stripping device **12*a* and the hold down device 11*a* are in operative position in advance of the knitting zone and the layering device 10*a*** is in operative follow up position to the knitting zone.

Each knitting system or zone is assigned a pair of rotatable heads 15 and 16 and the shifting of the locking slides 19 and **19*a* as well as the rotation of the heads 15 and 15** are effected automatically through conventional means at the termination of each pass of the carriage at opposite sides of the knitting machine.

While the invention has been particularly shown and described with reference to a preferred embodiment thereof, it will be understood by those in the art that varous changes in form and details may be made therein without departing from the spirit and scope of the invention.

What is claimed is:

1. In a straight knitting machine of the type having a pair of needle beds and knocking-over combs arranged in an inverted V-shaped configuration and means carried by the sliding carriage for displacing rows of stitches beneath a needle crossover zone, the improvement comprising:

stop means formed by horizontal edges on said knocking-over combs located beneath vertical knocking-over edges on said combs for limiting the upward movement of the formed rows of stiches, stripping means and hold down means for the preceding row of stitches carried by said carriage in advance of the knitting zone, and layering means for newly formed stitches carried by said carriage behind the knitting zone in the direction of travel of the carriage.

2. A straight knitting machine as set forth in claim 1, wherein said layering means is comprised of a spring bracket having a substantially horizontally portion adapted to engage and push the knitted piece downward and place the newly formed stitches behind said stop means.

3. A straight knitting machine as set forth in claim 1, wherein said stripping means is comprised of a wire bracket adapted to slide on the lower edges of the needles when said needles are advanced.

4. A straight knitting machine as set forth in claim 1, wherein said hold down means is comprised of a spring wire disposed behind said stripping means in the direction of travel, said spring wire having an essentially horizontal portion for holding the preceding row of stitches behind said stop means.

5. A straight knitting machine as set forth in claim 1, wherein said layering means, said stripping means and said hold down means are each attached to a rotatable head adapted to be rotated 90° between first and second positions, said layering means being displaced relative to said stripping means and said hold down means on said rotatable head by 90°.

6. A straight knitting machine as set forth in claim 5, further comprising an additional swivel head having layering means, stripping means and hold down means mounted thereon with said additional rotatable head being a mirror image of said first mentioned rotatable head.

7. A straight knitting machine as set forth in claim 5, further comprising support means movable with said sliding carriage and means for rotatably mounting said rotatable heads on said support means on opposite sides of the knitting zone as said carriage moves over said needle bed.

* * * * *